US007460817B2

(12) United States Patent
Saito

(10) Patent No.: US 7,460,817 B2
(45) **Date of Patent: *Dec. 2, 2008**

(54) IMAGE FORMING APPARATUS

(75) Inventor: Hiroshi Saito, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 32 days.

This patent is subject to a terminal disclaimer.

(21) Appl. No.: 11/552,795

(22) Filed: Oct. 25, 2006

(65) Prior Publication Data

US 2007/0047987 A1 Mar. 1, 2007

Related U.S. Application Data

(62) Division of application No. 10/983,727, filed on Nov. 9, 2004, now Pat. No. 7,149,448.

(30) Foreign Application Priority Data

Dec. 9, 2003 (JP) ..... 2003-410483
Oct. 8, 2004 (JP) ..... 2004-296781

(51) Int. Cl.
*G03G 15/08* (2006.01)

(52) U.S. Cl. ..... 399/223; 399/53; 399/54; 399/227

(58) Field of Classification Search ..... 399/38, 399/53, 54, 222, 223, 224, 226, 227
See application file for complete search history.

(56) References Cited

U.S. PATENT DOCUMENTS 5,567,997 A 10/1996 Suzuki et al. ..... 307/127
6,345,160 B1 2/2002 Matsuo et al. ..... 399/53
6,415,114 B1 7/2002 Nakazato et al. ..... 399/49
6,504,619 B1 * 1/2003 Kageyama et al. ..... 358/1.14
6,701,110 B2 3/2004 Ono ..... 399/226
6,763,202 B2 7/2004 Maeda ..... 399/53
7,058,326 B2 6/2006 Toyama ..... 399/50
7,242,873 B2 * 7/2007 Saisu et al. ..... 399/12

FOREIGN PATENT DOCUMENTS

JP 8-129277 5/1996
JP 2000-352869 12/2000

* cited by examiner

*Primary Examiner*—Hoan H Tran
(74) *Attorney, Agent, or Firm*—Fitzpatrick, Cella, Harper & Scinto

(57) ABSTRACT

An image forming apparatus includes a plurality of developing portions capable of developing electrostatic latent images formed on an image bearing member, and a control portion for executing preparation operations for developing operations with respect to each of the plurality of developing portions. The image forming apparatus has a first mode for conducting image formation by use of the plurality of developing portions, and a second mode for conducting the image formation by use of only a predetermined developing portion in the plurality of developing portions. The preparation operations for the predetermined developing portion are executed earlier than the preparation operations of the developing portions other than the predetermined developing portion in the plurality of developing portions, and the image formation in the second mode can be done earlier than the first mode.

9 Claims, 4 Drawing Sheets

IMAGE FORMING APPARATUS

This application is a divisional of Application No. 10/983,727, filed Nov. 9, 2004, now allowed.

BACKGROUND OF THE INVENTION

1. Field of the Invention

The present invention relates to an image forming apparatus such as a copying machine, a printer, etc., which includes a plurality of developing means for developing an electrostatic latent image formed on an image bearing member by an electrophotographic method and an electrostatic recording method.

2. Related Background Art

FIG. 1 shows a schematic sectional view of a color image forming apparatus that has hitherto been utilized. In this example, an upper part of this color image forming apparatus is a digital color image reader portion 101 for reading image data from external information, and a lower part thereof is a digital color image printer portion 102 for forming an image on a recording material on the basis of the image data read by the digital color image reader portion 101.

In the image reader portion 101, an original 30 is placed on an original plate glass 31 and is exposure-scanned by an exposing lamp 32, and fluxes of image light reflected from the original 30 are converged at a full-color sensor 34 via a lens 33, thereby obtaining color separation image signals. These color separation image signals are transmitted through an (unillustrated) amplifier circuit, then subjected to processing in a video processing unit (not shown) and sent to the printer portion 102.

Installed in the printer portion 102 are the image bearing member and image forming means for forming the images on the image bearing member, such as a charging means, an exposure means serving as a latent image forming means, a developing means, a transferring means for transferring the image on the image bearing member onto the recording material defined as a transferring medium in this example, a fixing means for fixing the image to the recording material, etc., wherein a so-called image forming process is executed.

In this printer portion 102, a photosensitive drum 1 defined as the image bearing member is so held as to be rotatable in an arrowhead-direction. Disposed around the photosensitive-drum 1 are a pre-exposing lamp 11, a corona charging device 2 defined as a changing means, a laser exposing optical system 3 as an exposing means, an electric potential sensor 12, four pieces of developing devices 4*y*, 4*c*, 4*m*, 4*bk* as developing means which respectively contain developers assuming different colors that are herein yellow, cyan, magenta and black, an on-drum light amount detecting means 13, a transferring device 5 as a transferring means, and a cleaning device 6.

To begin with, when forming the image by the printer portion, in an image forming process, the photosensitive drum 1 is rotated in the arrowhead-direction. The photosensitive drum 1, of which electric charges have been eliminated by the pre-exposing lamp 11, is uniformly charged by the charging device 2 in a charging process.

Next in a latent image forming process, in the laser exposing optical system 3, the image signals from the image reader portion 101 are converted into optical signals by a laser output portion (unillustrated), and thus-converted laser beams E are reflected by a polygon mirror 3*a*, then travel through a lens 3*b* and a mirror 3*c* and are projected on a peripheral surface of the photosensitive-drum 1, whereby light images E assuming respective separation colors fall upon the photosensitive drum 1 with the result that the latent images are formed thereon.

In a developing process, the latent images on the photosensitive drum 1 are developed by operating predetermined developing devices, whereby developer images (toner images) of the developers, of which a base substance is resin, are formed on the photosensitive drum 1. The developing devices are so constructed as to selectively, singly get close to the photosensitive drum 1, corresponding to each separation color as one of eccentric cams 24*y*, 24*c*, 24*m*, 24*bk*, which operate as moving members.

In a transferring process, the toner images on the photosensitive drum 1 are transferred onto a recording material P as a transferring medium supplied to a position facing the photosensitive drum 1 from a recording material cassette 7 via a conveying system 23 and the transferring device 5. The transferring device 5 in this example includes a transferring drum 5*a*, a transferring brush 5*b*, an attraction brush 5*c* for electrostatically attracting the recording material P, an attraction roller 5*g* facing the attraction brush 5*c*, an inside charging device 5*d* and an outside charging device 5*e*. A transferring sheet 5*f*, which is formed of a dielectric substance and bears the recording material P, is looped round in a cylindrical shape integrally in a way that pastes onto a connecting plate 5*i* in a peripheral surface opening area of the transferring drum 5*a* so axially supported as to be rotationally driven. The transferring sheet 5*f* involves using a dielectric sheet such as a polycarbonate film, etc. In this drum-shaped transferring device 5, as the transferring drum 5*a* is rotated, the toner images on the photosensitive drum 1 are transferred onto the recording material P defined as the transferring medium that is borne on the transferring sheet 5*f* by the transferring brush 5*b* serving as a transferring charging device. Thus, a desired number of color images (toner images) are transferred in superposition onto the recording material P carried while being attracted to the transferring sheet 5*f*, thereby forming a full-color image.

In the case of forming the full-color image, upon thus finishing the 4-color toner image, the recording material P is separated from the transferring drum 5*a* by dint of operations of a separation pawl 8*a*, a separation push-up roller 8*b* and a separation charging device 5*h*, and is discharged into a tray 10 through a heat roller fixing device 9.

On the other hand, subsequently to the transfer, residual toners on the surface of the photosensitive drum 1 are, after being cleaned by the cleaning device 6, reused for the image forming process.

By the way, if the apparatus remains unused for a long period of time, there decreases triboelectricity of the toners and of the developers in the developing devices. Therefore, for gaining stability by increasing the triboelectricity within the developing device at a power-on time of the apparatus, a developing device preparation process for idle rotations (idling) of each developing device is provided in a preparation process before executing the aforementioned image forming process. Also, an execution means for executing this developing device preparation process is provided. The developing device preparation process is described in Japanese Patent Application Laid-Open Nos. H8-129277 and 2000-352869.

When the idling of the developing device is conducted, the developing device is made to face the photosensitive drum 1 charged at a predetermined electric potential in order to prevent a scatter of toners. Further, in the developing device preparation process wherein the developing device is subjected to the idling, after the idling has been finished, a density of a predetermined patch pattern developed on the photosensitive drum 1 is read. Gradations are corrected based on a result of the reading, and copy preparation operations from a power-on startup operation down to a possible-of-copying operation are conducted starting from the aforementioned developing device in accordance with a rotation.

FIG. 4 shows a flowchart of the copy preparation operations related to the developing device in the developing device preparation process at a power-on time.

After the power-on in step S1, the idling of the black developing device 4*bk* is started in step S2. When the idling of the black developing device 4*bk* is effected for a predetermined period of time, the idling of the yellow developing device 4*y* is next started in step S3. Similarly, the idling of the magenta developing device 4*m* and the idling of the cyan developing device 4*c* are sequentially performed in steps S4 and S5.

After the idling of the four-color developing devices has been finished, patch patterns exhibiting several types of predetermined densities are formed on the photosensitive drum 1 by the developing devices in steps S6 to S9. An on-drum light amount detecting means 13 reads the densities of these patch patterns formed thereon, and the gradation correcting operations are conducted in sequence for the respective colors. After finishing the developing device preparation process in steps S1 to S9, a normal multicolor image formation (full-color image formation) process is started.

In this type of full-color image forming apparatus, however, not only in the case of effecting the full-color image formation by way of a first mode but also in the case of performing the single-color image formation involving the use of only one predetermined developing device by way of a second mode, the four-color developing devices have hitherto been sequentially subjected to the idling in the developing device preparation process from the power-on operation down to the possible-of-copying operation in the same way as the developing device preparation process shown in FIG. 4. Therefore, even in the case of the single-color image formation, e.g., taking a black-and-white copy, the idling of the unnecessary developing devices was carried out, which required a considerable period of time.

SUMMARY OF THE INVENTION

It is an object of the present invention to provide an image forming apparatus including a plurality of developing devices serving as image forming means and having two types of image formation modes, such as a first mode for effecting color image formation involving the use of all of the plural developing devices and a second mode for performing single-color image formation involving the use of only a predetermined developing device therein. In this manner, preparation time for conducting the single-color image formation as the second mode is reduced.

An image forming apparatus preferred for accomplishing the above object comprises a plurality of developing means capable of developing electrostatic latent images formed on an image bearing member, and control means for executing preparation operations for developing operations with respect to each of the plurality of developing means. The image forming apparatus has a first mode for conducting image formation by use of the plurality of developing means, and a second mode for conducting the image formation by use of only predetermined developing means in the plurality of developing means. The control means executes the preparation operations for the predetermined developing means earlier than the preparation operations of the developing means other than the predetermined developing means in the plurality of developing means, and enables the image formation to be done in the second mode earlier than the first mode.

DETAILED DESCRIPTION OF THE EMBODIMENT

An image forming apparatus according to the present invention will be described in greater detail with reference to the drawings.

Embodiment 1

The present invention relates to a color image forming apparatus in which a plurality of developing devices are installed. A whole configuration of the image forming apparatus in the present embodiment is the same as that of the conventional apparatus explained referring to FIG. 1, and, since the normal image forming process is the same, the detailed explanations thereof are omitted.

Figure 1:
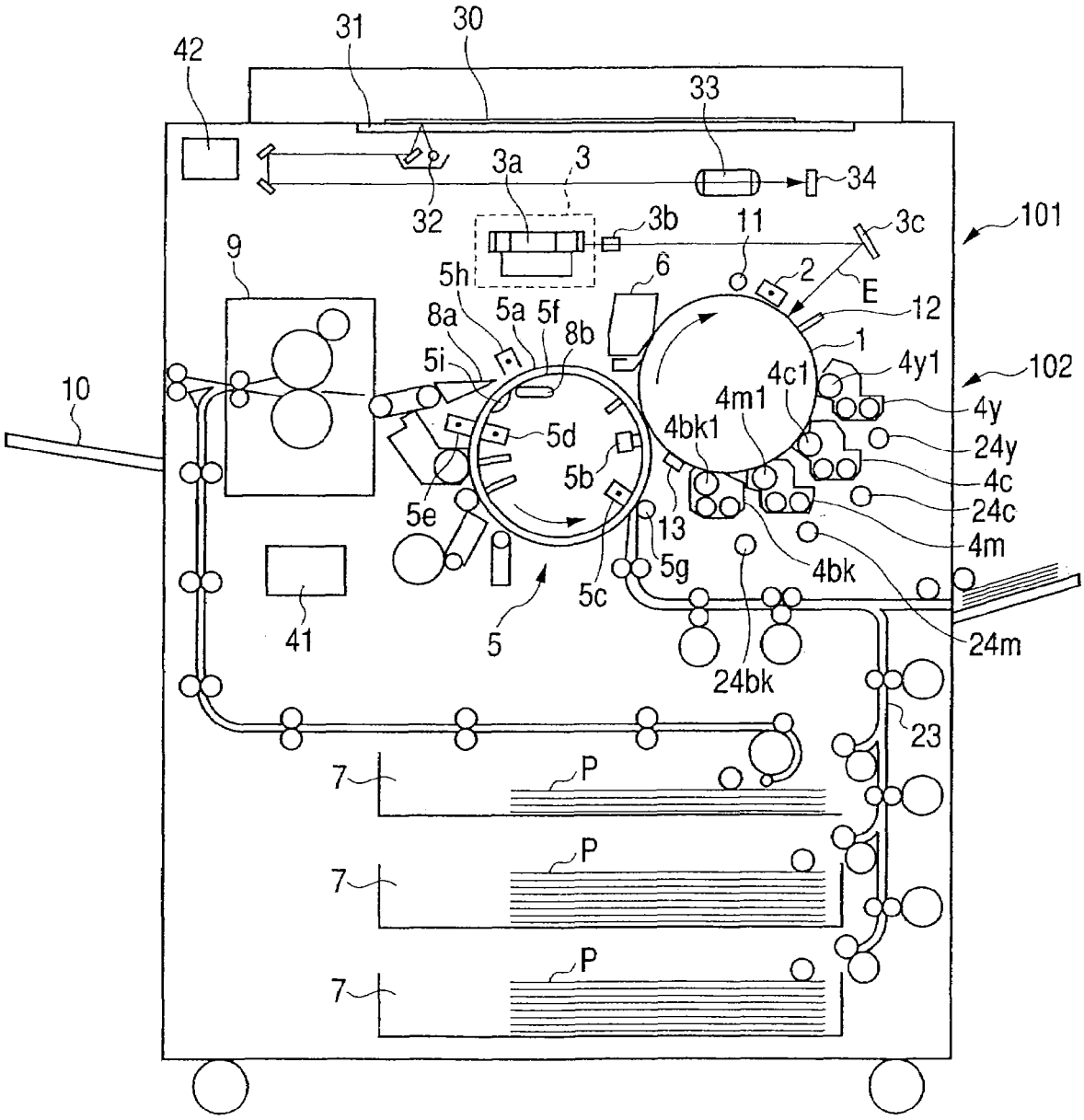
FIG. 1 is a schematic configurational view showing one example of an image forming apparatus according to the present invention.

Namely, the present embodiment exemplifies the image forming apparatus having, as shown FIG. 1, a configuration that includes a digital color image reader portion 101 in an upper part thereof and a digital color image printer portion 102 in a lower part thereof. In the printer portion 102, a photosensitive drum 1 defined as an image bearing member is so held as to be rotatable in an arrowhead-direction. Disposed around the photosensitive drum 1 are a pre-exposing lamp 11, a corona charging device 2 defined as a changing means, a laser exposing optical system 3, an electric potential sensor 12, four pieces of developing devices 4*y*, 4*c*, 4*m*, 4*bk* which respectively contain developers assuming different colors that are yellow, cyan, magenta and black, a toner image density detecting means 13, a transferring device 5 and a cleaning device 6 as image forming means.

Then, in a charging process by the charging device 2, the surface of the photosensitive drum 1 defined as an image bearing member is uniformly charged with electricity. An exposing process is executed in a laser exposing optical system 3, thereby forming latent images on the surface of the photosensitive drum 1. Next, in a developing process, the latent images on the photosensitive drum 1 are developed by operating predetermined developing devices, whereby developer images (toner images) are formed on the photosensitive drum 1. In a transferring process, the toner images on the photosensitive drum 1 are transferred onto a recording material P as a transferring medium supplied to a position facing the photosensitive drum 1 from a recording material cassette 7 via a conveying system and the transferring device 5. A full-color image formed on the recording material P is fixed onto the recording material P by a heat roller fixing device 9 in a fixing process, and the recording material P is then discharged into a tray 10.

The present image forming apparatus is capable of two types of image forming modes, such as a full-color image forming mode, i.e., a multicolor image forming mode (a first mode) involving the use of all the developing devices 4*y*, 4*m*, 4*c*, 4*bk* as one category of image forming means among those provided therein, and a single-color image forming mode (a second mode) for forming a black-and-white image by employing only a predetermined developing device, e.g., the black developing device 4*bk* in the present embodiment.

Then, the image forming apparatus in the present embodiment has a means capable of reserving not-yet-conducted image formation.

An image formation reserving means 41 executes a reservation job of enabling a want-to-copy original to be read even during a print preparation process of the image forming apparatus and storing a control portion storage means 41 with pieces of setting information such as the number of copies that contain readout image information, and executes a print job as a reservation job stored in the storage means 41 when becoming printable condition.

Further, this image formation reserving means 41 is capable of reserving a plural number of times with which the image formation is to be carried out. After one single print job has been stored in the control portion storage means, the storage portion is similarly stored with another different print job, and the apparatus executes sequentially the plurality of stored print jobs when the apparatus becomes printable condition.

The execution means for executing the same preparation process in the image forming process as the process in the prior art, executes likewise sequentially a, developing device preparation process for each of the developing devices 4*y*, 4*m*, 4*c*, 4*bk* in order to stabilize the triboelectricity of the developers also in the present embodiment. Respective developing devices include developing sleeves 4*yl*, 4*ml*, 4*cl*, 4*bkl* as developer carrying rotatable members carrying the respective developers. In this respect, according to the present embodiment, the developing device preparation process sequence in the conventional example is changed, and, in the case of the single-color image formation, time for the developing device preparation process is reduced so as to enable the image formation to be started before the preparation processes of all of the color developing devices are finished.

Namely, in the conventional example, gradations are corrected in the respective developing devices after the idling of all the developing devices has been finished, and hence the image formation process is started after the ends of all the developing device preparation processes. According to the present embodiment, however, the idling and the gradation correction are performed in one single developing device, and, with termination of preparation operations thereof, the single-color image formation in the concerned color is permitted. Therefore, the image formation can be started before a start of other developing device preparation processes. A scheme for giving the permission of the image formation is, for example, such that a CPU serving as a notifying means inputs a command signal to a liquid crystal display portion as a display means 42 provided on an upper part of the image forming apparatus, so that a message such as "Black single-color image formation is available" is displayed on the liquid crystal display portion. Note that the notifying means is, in the case of functioning as a printer for forming the image by receiving a print command from a personal computer connected via a network to the image forming apparatus, constructed to transmit the command signal to the personal computer via a network cable.

Figure 2:
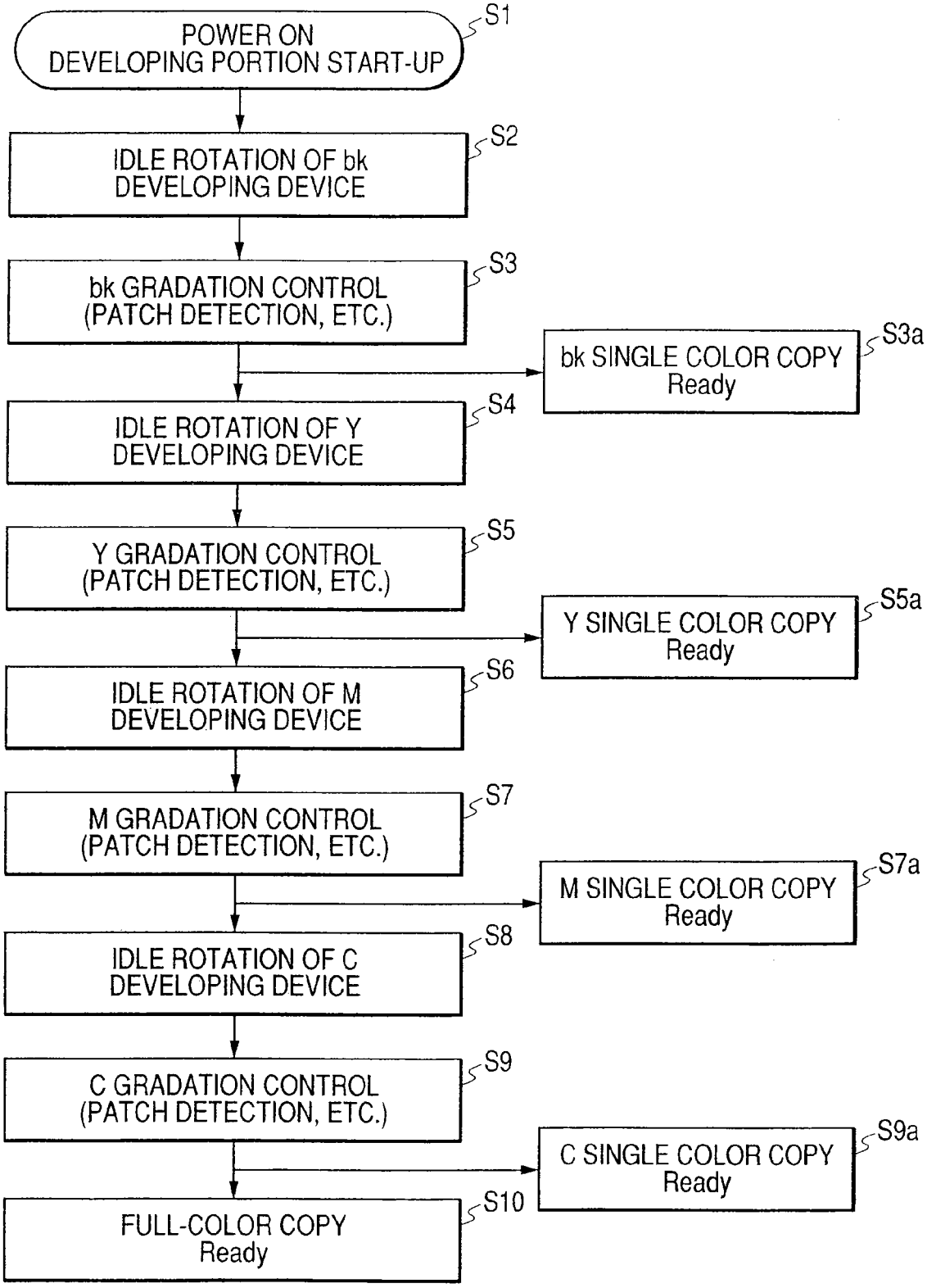
FIG. 2 is a flowchart showing operations in one example of a developing device preparation process according to the present invention.

FIG. 2 shows a flowchart of operations performed according to the developing device preparation process in the present embodiment.

After power-on in step S1, the developing sleeve 4*bkl* of the black developing device 4*bk* is rotated without involving any of the developing operations, i.e., so-called idle rotations (idling) are started in step S2 by way of a development-related preparation operation. After an elapse of a predetermined period of time needed for stabilizing the triboelectricity, the idling is stopped. In step S3, a gradation correcting operation for developing in black is next conducted. The gradation correcting operation connoted herein is an operation of forming a desired latent image on the photosensitive drum 1, developing this latent image by the black developing device 4*bk*, detecting this developed image by the density detecting means 13, and correcting a latent image forming condition, a developing condition, etc., on the basis of a result of this detection. The preparation operations are controlled by a control means 41 and carried out similarly in the developing devices containing other color developers.

In the present embodiment, at a stage of step S3, there is permitted the operation for the black single-color image formation, i.e., the operation in the black-and-white copy (print) mode. If there is a reservation for the black-and-white print mode job at this point of time, the black-and-white printing reserved in step S3*a* is effected.

Subsequently, the idling of the yellow developing device 4*y* is performed in step S4, and the gradation correcting operation is carried out in step S5. The operation in the yellow single-color print mode is permitted in step S5*a*. Hereinafter similarly, the single-color print mode is permitted sequentially in the gradation correcting operations respectively in step S7 and step S9 with respect to magenta and cyan in steps S6 to S9. Then, the single-color printing (the single-color image formation) is executed in step S7*a* and step S9*a*, and finally the multicolor image formation (full-color print) mode is permitted in step S10.

Thus, in the case of conducting the single-color image formation such as the black-and-white printing, if set so that both of the idling and the gradation correction in the developing device preparation process for the target-color developing device are performed anterior to other developing devices, it is possible to reduce the time expended till the other-color developing device preparation processes are finished. Hence, waiting time since the power-on is reduced, and usability is improved.

Namely, in the image forming apparatus according to the present invention, the developing device preparation process includes the individual preparation processes that are provided in sequence for the plurality of developing devices. In the individual preparation process for the single developing device, the preparation operations for this developing device shall be all completed.

Accordingly, in the present embodiment, both of the idling and the gradation correction are conducted as the preparation operations for the developing device. However, both of these preparation operations are all finished in one individual preparation process. It never happens that the individual preparation process for another developing device is executed until the individual preparation process for the single developing device is finished. If an operation other than the idling and the gradation correction is carried out as the preparation operation for the developing device and if a different operation therefrom is performed, all the preparation operations for that developing device are conducted in one individual preparation process.

Then, in the case of effecting the single-color image formation such as the black-and-white copy obtained in the present embodiment, the single-color image formation process is provided after the individual preparation process for the target-color developing device. Namely, after finishing the preparation operations for the developing device to be employed, the image formation is conducted by this developing device before performing the preparation operations for the other developing device.

That is to say, according to the present embodiment, the black-and-white copy is obtained, and hence the black developing device preparation process is executed at first in FIG. 2. If there is a high frequency of obtaining other single-color copy, however, it is preferable that this color developing device preparation process be executed earlier.

Then, there are a plurality of reservation print jobs, and, if at least one of these reservation print jobs is the single-color image formation, this single-color image formation in the color concerned is executed earlier by preferentially performing the preparation operations for only this color developing device. Thereafter, as in the present embodiment, the multicolor image formation (full-color print) is carried out.

On the occasion of this full-color print, since there exists the developing device for which the preparation operations have already been completed in the single-color image formation preparation process effected last time, it is unnecessary to newly provide the preparation process for this developing device, whereby the time is reduced to an extent corresponding thereto.

As described above, in the image forming apparatus having the plurality of developing devices and capable of executing both of the multicolor image formation process and the single-color image formation process, the developing device preparation process includes the individual preparation processes that are provided in sequence for the plurality of developing devices. In the individual preparation process for one developing device, when performing the single-color image formation after all the preparation operations for this developing device have been completed, the single-color image formation process is provided after the individual preparation process for the developing device to be used in the developing device preparation process, and therefore the image formation time is made shorter than in the prior art.

Note that the embodiment described above has exemplified the case of accepting the black single-color reservation job. However, the present invention can be applied, without being limited to this case, to a case of taking such a configuration that if the image forming apparatus has the black single-color mode and a predetermined image formation mode (a 2-color mode using, e.g., black and yellow) that does not use all the developing devices in addition to the full-color image formation mode, the preparation operations are executed preferentially from the developing device(s) (which is the black developing device, or the black and yellow developing devices) used for the image formation modes other than the full-color image formation mode in consideration of the black single-color mode and the aforementioned image formation mode. Thus, the image formation mode (the black single-color mode or the 2-color mode) can be started just when the preparation operations for the developing device concerned are completed without waiting for the completion of the preparation operations for the remaining developing devices.

It is to be noted that the construction given herein is that the toner images are transferred from the photosensitive drum 1 directly onto the recording medium P serving as the transferring medium. The present invention can, however, be applied to a construction adopting an intermediate transfer method of transferring, after the toner images have been once transferred onto an intermediate transferring member from the photosensitive drum 1 with this intermediate transferring member serving as a transferring medium, the images onto the recording medium P from the intermediate transferring member.

Other elements such as the number of the developing devices and the colors are not particularly limited. For others, the whole construction of the image forming apparatus is not particularly limited if constructed to employ the plurality of developing devices for whatever type. Then, the present invention can be applied to an image forming apparatus constructed so that the developing devices serving as moving members are mounted on a rotary member, and the developing devices are made to sequentially face the photosensitive drum through the rotations of the rotary member, and to an in-line type image forming apparatus including the developing devices provided respectively for a plurality of photosensitive drums.

Figure 3:
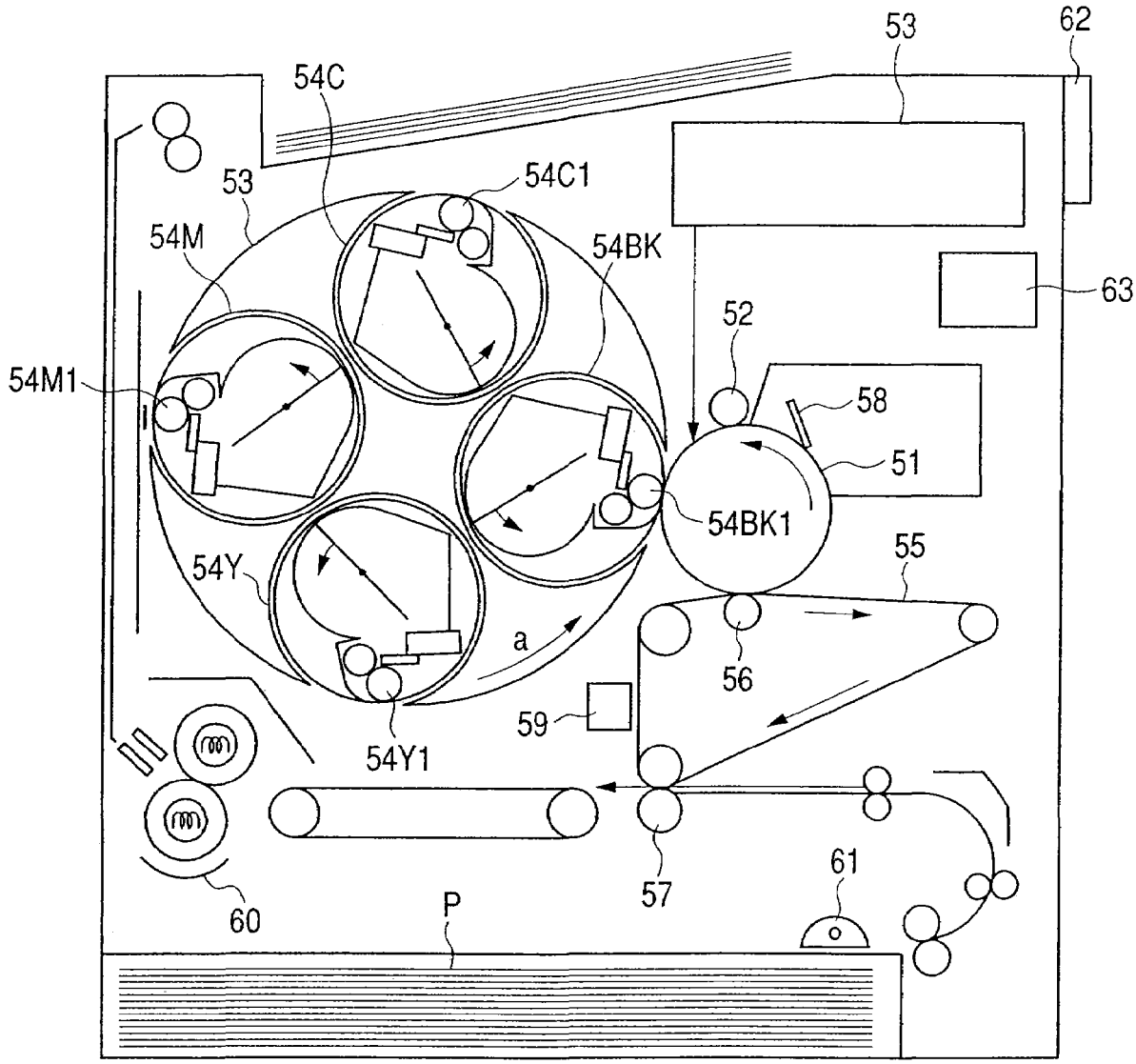
FIG. 3 is a schematic configurational view showing another example of the image forming apparatus according to the present invention.
Figure 4:
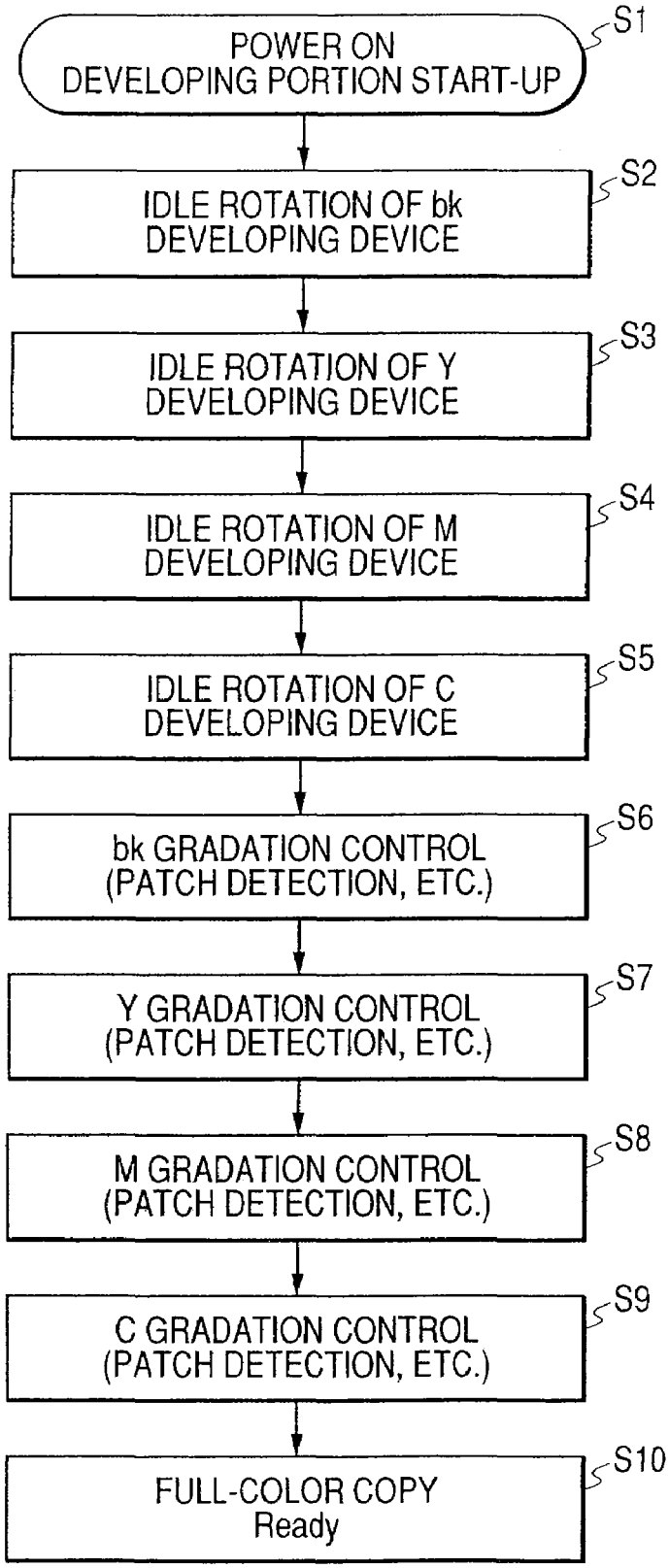
FIG. 4 is a flowchart showing operations in one example of a developing device preparation process in the prior art.

FIG. 3 is a view illustrating the image forming apparatus constructed so that the developing devices serving as the moving members are mounted on the rotary member, and the developing devices are made to sequentially face the photosensitive drum through the rotations of the rotary member. The image forming apparatus in FIG. 3 has basically the same construction as that in the preceding embodiment, except that this image forming apparatus is constructed to use rotary type developing devices and involves using the intermediate transferring member.

In FIG. 3, an electrostatic latent image is formed on the surface of a photosensitive drum 51 uniformly charged by a charging roller 52 by effecting an exposure with an exposing means 53. Then, this latent image is developed by developing devices 54Bk (black), 54Y (yellow), 54M (magenta), 54 C (cyan) mounted on the rotary member (moving member) 53. Respective developing devices include rotatable developing sleeve devices 54Bkl, 54Yl, 54Ml, 54Cl each carrying the developer. Then, a desired developing device among the respective developing devices moves, as the rotary member rotates, to a developing position, i.e., a face-to-face portion that faces the photosensitive drum 1, and performs the developing operation. Note that among the eveloping sleeves, only the developing sleeve of the developing device having moved to the developing position becomes rotatable by an unillustrated driving means. The images developed by the respective developing devices are sequentially transferred onto an intermediate transferring belt 55 serving as an intermediate transferring member by a primary transferring means 56. These images superimposed on each other are batchwise transferred by a secondary transferring-means 57 onto the transferring material P fed by a sheet feeding means 61. The image transferred batchwise onto the transferring material P is fixed by a fixing means 60. Residual toners left on the photosensitive drum 1 when transferred onto the intermediate transferring belt 55, are collected by a cleaner 58. Incidentally, the numeral 59 represents a density detecting means for detecting a density of the thus-formed toner image for controlling gradations, and so on.

In the image forming apparatus in FIG. 3, to begin with, the developing device 54Bk is moved to the developing position and performs the preparation operations explained also in the preceding embodiment, i.e., the idling of the developing sleeve 54Bkl of the developing device 54Bk and the gradation correcting operation therein are conducted, thus enabling at first the developing device 54Bk to start the developing operation. Then, thereafter, the other developing devices are moved one by one to the developing position, wherein each of the developing devices implements the preparation operation. It. should be noted that a control means 63 controls these preparation operations needed for the developing means to start the developing operation. Further, the displaying means explained in the preceding embodiment corresponds to a means 62 in FIG. 3.

Embodiment 2

The embodiment 1 discussed above has exemplified the construction that gives the priority to the black single-color mode, however, the following construction may also be embodied.

Upon power-on of a main power source of the image forming apparatus, or when recovered from a standby status, if the reservation job of the image formation is inputted, when the developing device used for this reservation job is judged to be only the yellow developing device, the CPU executes at first preferentially the preparation operations of the yellow developing device, and starts the image formation for the reservation job with the end of the preparation operations of the yellow developing device without waiting for the completion of the preparation operations of the developing devices other than the yellow developing device.

With this construction taken, the time until the desired image formation is completed after the image formation job has been accepted can be reduced to the greatest possible degree, whereby an image forming apparatus highly satisfactory to users can be provided.

This application claims priority from Japanese Patent Application Nos. 2003-410483 filed Dec. 9, 2003 and 2004-296781 filed Oct. 8, 2004, which are hereby incorporated by reference herein.

What is claimed is:

1. An image forming apparatus comprising:

a plurality of developing devices capable of developing electrostatic images; and a controller for executing a preparation operation for a developing operation with respect to each of said plurality of developing devices, wherein said image forming apparatus has a first mode for conducting image formation by use of said plurality of developing devices, and a second mode for conducting the image formation by use of only a predetermined developing device of said plurality of developing devices, and wherein said controller executes the preparation operation for the developing operation of said predetermined developing device earlier than the preparation operations for the developing operations of the developing devices other than said predetermined developing device of said plurality of developing devices, and enables the image formation to be effected in the second mode earlier than that in the first mode.

2. An image forming apparatus according to claim 1, wherein said controller is capable of accepting a reservation for an image formation job, and executes, in the case where the reserved image formation is executed in the second mode, the preparation operation for the developing operation of said predetermined developing device earlier than the preparation operations for the developing operations of said developing devices other than said predetermined developing device of said plurality of developing devices, and starts the reserved image formation of the reserved image formation job after finishing the preparation operation for the developing operation of said predetermined developing device.

3. An image forming apparatus according to claim 1, further comprising a, display device for displaying that the image formation is possible, wherein said display device displays that the image formation in the second mode is possible after the preparation operation for the developing operation of said predetermined developing device has been finished, and thereafter, displays that the image formation in the first mode is possible after the preparation operations for the developing operations of said developing devices, other than said predetermined developing device of said plurality of developing devices, have been finished.

4. An image forming apparatus according to claim 1, wherein each of said plurality of developing devices comprises a rotatable developer carrying member for carrying a respective developer, and wherein said controller executes the preparation operation for the developing operation in a way that rotates said developer carrying member for a predetermined period of time.

5. An image forming apparatus according to claim 4, further comprising a moving member mounted with said plurality of developing devices and capable of moving a desired developing device to a face-to-face position that faces an image bearing member on which the electrostatic image is formed, wherein only said developer carrying member of said developing device in the face-to-face position, among said plurality of developing devices, is rotatable.

6. An image forming apparatus according to claim 1, further comprising density detecting devices for detecting a density of a developer image, wherein said controller executes the preparation operation for the developing operation by performing such an operation that said density detecting device detects an image into which a predetermined electrostatic image formed on an image bearing member is developed by each of said developing devices.

7. An image forming apparatus according to claim 1, wherein said predetermined developing device has a black developer.

8. An image forming apparatus according to claim 1, wherein said controller permits the image formation in the second mode after finishing the preparation operation for the developing operation of said predetermined developing device.

9. An image forming apparatus according to claim 8, wherein said controller executes the preparation operations for the developing operations of the developing devices, other than said predetermined developing device of said plurality of developing devices, after finishing the image formation in the second mode.

* * * * *